US011396988B2

(12) United States Patent
Ishida

(10) Patent No.: US 11,396,988 B2
(45) Date of Patent: Jul. 26, 2022

(54) VEHICLE LED LAMP HAVING A BULB BASE TENSIONING SPRING

(71) Applicant: Morimoto Lighting, LLC, Atlanta, GA (US)

(72) Inventor: Yoshitaka Ishida, Hesperia, CA (US)

( * ) Notice: Subject to any disclaimer, the term of this patent is extended or adjusted under 35 U.S.C. 154(b) by 0 days.

(21) Appl. No.: 17/099,398

(22) Filed: Nov. 16, 2020

(65) Prior Publication Data

US 2022/0154903 A1 May 19, 2022

(51) Int. Cl.
*F21S 41/19* (2018.01)
*F21S 41/141* (2018.01)
*F21S 41/657* (2018.01)

(52) U.S. Cl.
CPC ..... *F21S 41/198* (2018.01); *F21S 41/141* (2018.01); *F21S 41/657* (2018.01)

(58) Field of Classification Search
CPC ..... F21S 41/19–198; F21S 41/141; F21S 41/65–657; H01R 33/0845; H01R 33/0872; H01R 33/20
See application file for complete search history.

(56) References Cited

U.S. PATENT DOCUMENTS 4,679,128 A * 7/1987 Van Duyn ..... F21S 41/194 362/306
10,161,614 B2 12/2018 Creusen et al.
10,415,787 B2 9/2019 Lessard et al.
2013/0272010 A1* 10/2013 Kawamura ..... F21S 41/162 362/519
2014/0085921 A1* 3/2014 Petker ..... F21S 41/162 362/548
2019/0242542 A1* 8/2019 Hou ..... F21S 41/194

FOREIGN PATENT DOCUMENTS

| | | | | |
|---|---|---|---|---|
| CN | 109140371 A | * | 1/2019 | ..... F21S 41/194 |
| CN | 111120961 A | * | 5/2020 | |
| DE | 102007022028 A1 | * | 11/2008 | ..... F21S 41/192 |
| EP | 1043546 A2 | * | 10/2000 | ..... F21S 41/192 |
| JP | 2019192389 A | * | 10/2019 | |
| KR | 20110115018 A | * | 10/2011 | |
| KR | 20150100163 A | * | 9/2015 | |
| KR | 20160029926 A | * | 3/2016 | |
| KR | 20180077698 A | * | 7/2018 | |
| WO | WO 2017/220394 A1 | | 12/2017 | |

* cited by examiner

*Primary Examiner* — Mariceli Santiago
(74) *Attorney, Agent, or Firm* — Eric Hanscom

(57) ABSTRACT

The present subject matter relates to headlight bulb devices, systems, and methods for vehicle headlights in which a headlight bulb assembly includes a bulb mounting collar configured to be engaged with a bulb base cavity in a housing of the vehicle headlight; a bulb body comprising one or more LED element, wherein the bulb body is configured to be coupled to the bulb mounting collar, and wherein the bulb body is rotatable to a range of angular positions relative to the bulb mounting collar; and a tension spring configured to apply a biasing force that acts to retain one or both of the bulb mounting collar or the bulb body in a desired position with respect to the bulb base cavity.

18 Claims, 7 Drawing Sheets

VEHICLE LED LAMP HAVING A BULB BASE TENSIONING SPRING

TECHNICAL FIELD

The subject matter disclosed herein relates generally to headlight bulbs for a vehicle headlight. More particularly, the subject matter disclosed herein relates to LED headlight bulbs for use with vehicle lamp bases that require a minimum holding force.

BACKGROUND

Some standards for halogen vehicle lamp bases, such as H11, H8, H9 and H16, are specified to require a minimum holding force (e.g., a minimum of 5N of force) once the bulb is inserted into the fixture to ensure that the bulb is correctly seated to ensure alignment of the optics. Because the opening into which the bulb is inserted in the lamp housing must be slightly larger than the bulb itself to provide appropriate tolerances to allow the bulb to be inserted, such a holding force is typically achieved using a base tension spring that creates the minimum holding force when the bulb is seated. In some configurations, a spring that maintains such a holding force can also accordingly require a higher force during insertion (e.g., about 10N of force).

There have been attempts to adapt light-emitting-diode (LED) systems to replace such halogen bulbs, but the differences in the technologies have presented some challenges in successfully adapting LED bulbs to replace conventional halogen bulbs. For example, whereas halogen bulbs can be characterized as cylindrical filament light sources that emit light in a substantially 360 degree pattern, LED bulbs generally have a limited illumination range due to LED elements being surface-mounted devices. As a result, even with an efficient configuration that includes multiple LED elements facing in different directions, there can still be dark spots in the illumination pattern such that different angular positions of the LED elements relative to the fixture result in different lighting patterns. In addition, a vast majority of reflector housing designs have dimensions that are longer horizontally, and the outer segments of the reflector typically carry critical beam center intensity and cut-off defining roles. Taken together, the alignment of LED elements relative to the housing/reflector plays a critical role in adapting a LED bulb for a given housing/reflector design.

SUMMARY

In accordance with this disclosure, headlight bulb devices, systems, and methods for vehicle headlights are provided. In one aspect, a headlight bulb assembly for a vehicle headlight is provided. The headlight bulb assembly includes a bulb mounting collar configured to be engaged with a bulb base cavity in a housing of the vehicle headlight; a bulb body comprising one or more LED element, wherein the bulb body is configured to be coupled to the bulb mounting collar, wherein the bulb body is rotatable to a range of angular positions relative to the bulb mounting collar; and a biasing element configured to apply a force that acts to retain one or both of the bulb mounting collar or the bulb body in an engaged position with respect to the bulb base cavity.

In another aspect, a vehicle headlight is provided. The vehicle headlight comprises a housing comprising a bulb base cavity; a bulb mounting collar configured to be engaged with the bulb base cavity; a bulb body comprising one or more LED element, wherein the bulb body is configured to be coupled to the bulb mounting collar, wherein the bulb body is rotatable to a range of angular positions relative to the bulb mounting collar; and a biasing element configured to apply a force that acts to retain one or both of the bulb mounting collar or the bulb body in an engaged position with respect to the bulb base cavity.

In yet another aspect, a method for coupling a headlight bulb to a vehicle headlight is provided. The method includes steps of coupling a bulb body to a bulb mounting collar, the bulb body comprising one or more LED element; engaging the bulb mounting collar with a bulb base cavity in a housing of the vehicle headlight; and applying a biasing force between the bulb body and the bulb base cavity to hold the bulb body in a desired position relative to the bulb base cavity.

Although some of the aspects of the subject matter disclosed herein have been stated hereinabove, and which are achieved in whole or in part by the presently disclosed subject matter, other aspects will become evident as the description proceeds when taken in connection with the accompanying drawings as best described hereinbelow.

BRIEF DESCRIPTION OF THE DRAWINGS

The features and advantages of the present subject matter will be more readily understood from the following detailed description which should be read in conjunction with the accompanying drawings that are given merely by way of explanatory and non-limiting example, and in which.

DETAILED DESCRIPTION

Figure 1:
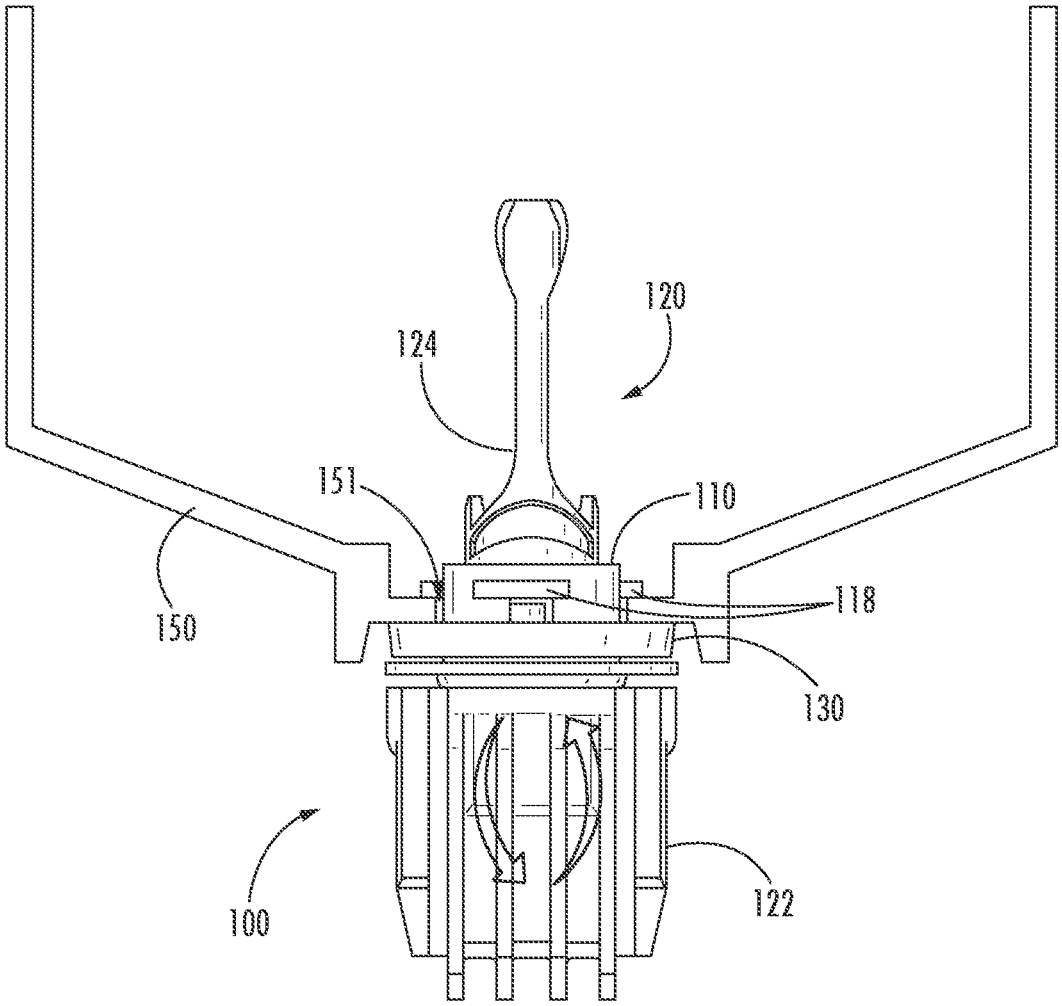
FIG. 1 is a side cutaway view of a headlight bulb assembly installed in a headlight housing according to an embodiment of the presently disclosed subject matter.

The present subject matter provides headlight bulb devices, systems, and methods for vehicle headlights. In one aspect, the present subject matter provides a headlight bulb for a vehicle headlight. In one exemplary configuration shown in FIG. 1, a headlight bulb assembly, generally designated 100, includes a bulb mounting collar 110 and a bulb body 120. Bulb mounting collar 110 is configured to be received in a bulb base cavity 151 in a housing 150 of the vehicle headlight, which can include a reflector arrangement configured to redirect the light from headlight bulb assembly 100 outwardly with a desired illumination pattern. In some embodiments, a mounting gasket 130 is provided to help seal a mating surface between bulb mounting collar 110 and bulb base cavity 151. Bulb body 120 is configured to be coupled to bulb mounting collar 110 such that bulb mounting collar 110 secures bulb body 120 in place with respect to housing 150.

Figure 2:
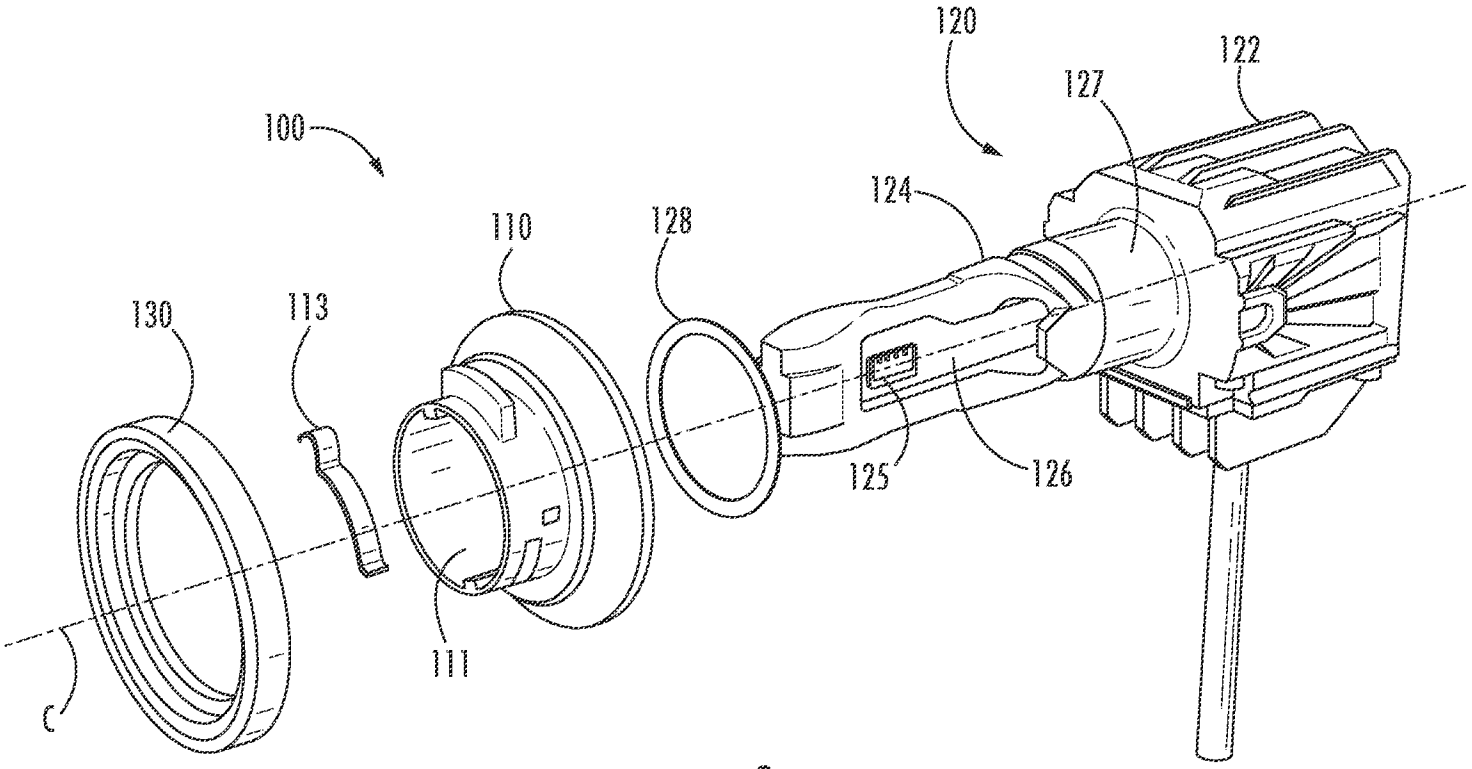
FIG. 2 is an exploded side perspective view of elements of a headlight bulb assembly according to an embodiment of the presently disclosed subject matter.

FIG. 2 illustrates an exploded view of the components of one exemplary configuration for headlight bulb assembly 100. In the illustrated configuration, bulb mounting collar 110 comprises a ring-shaped structure having a substantially circular opening therethrough and one or more mounting flange 118 (also shown in FIG. 1) configured for engaging a bulb base cavity 151 in a housing 150 as will be discussed below. Bulb body 120 includes a base portion 122 (also shown in FIG. 1), which may include one or more cooling system elements and/or control elements. For example, in some embodiments, base portion 122 can include one or more of cooling fins, cooling fans, printed circuit board controller elements, electrical connectors, or insulating elements. Bulb body 120 further includes an elongated shaft portion 124 that is connected to and extends from the base portion 122 substantially along a center axis C. The shaft portion 124 includes one or more LED element 125, which in some embodiments is carried on a circuit board element 126 that is integrated into the shaft portion 124.

As indicated above, bulb body 120 is configured to be coupled to bulb mounting collar 110. In some embodiments, the substantially circular opening in the ring-shaped structure of bulb mounting collar 110 is configured to receive bulb body 120 therethrough. Referring again to the embodiment shown in FIG. 2, the substantially circular opening through bulb mounting collar 110 can define a substantially cylindrical inner mounting surface 111, and a portion of shaft portion 124 of bulb body 120 can include an exterior mounting surface 127 that has a substantially cylindrical shape that is sized and configured to nest within and mate with inner mounting surface 111. In particular, for example, in some embodiments, shaft portion 124 is sized and configured at exterior mounting surface 127 to substantially correspond to a size and configuration of inner mounting surface 111 of bulb mounting collar 110 such that the surfaces can engage together in a press-fit arrangement. In addition, in some embodiments, headlight bulb assembly 100 can also include a coupling gasket 128 configured to help seal the connection between bulb mounting collar 110 and bulb body 120.

Alternatively or in addition, in some embodiments, headlight bulb assembly 100 includes one or more further engagement elements configured to enhance the alignment and/or engagement of bulb body 120 with bulb mounting collar 110. In some embodiments, such engagement elements are configured to selectively retain bulb mounting collar 110 and bulb body 120 in a desired relative angular orientation with respect to one another and/or in a desired axial position with respect to one another (e.g., along central axis C).

Figure 3:
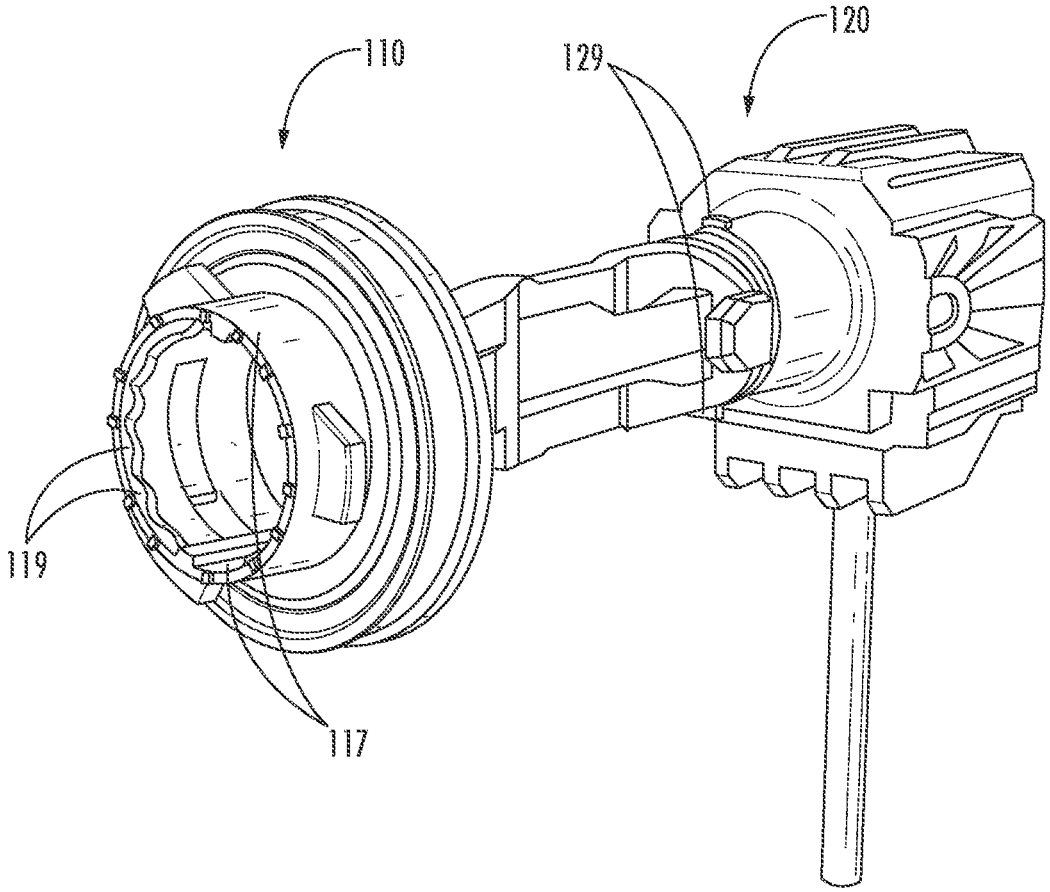
FIG. 3 is a perspective side view of elements of a headlight bulb assembly according to an embodiment of the presently disclosed subject matter.

Referring to an exemplary embodiment shown in FIG. 3, exterior mounting surface 127 of bulb body 120 can include a first engagement element in the form of one or more locking nub 129 that protrudes radially outward from exterior mounting surface 127. As illustrated in FIG. 3, for example, in some embodiments, two locking nubs 129 can be provided on substantially opposing sides of exterior mounting surface 127, although those having ordinary skill in the art will appreciate that more or fewer locking nubs can be provided to achieve a desired coupling configuration. Correspondingly, bulb mounting collar 110 can include a a second engagement element in the form of a plurality of alignment notches 119 indented radially inward into inner mounting surface 111, with each of the plurality of alignment notches 119 being configured to receive one of the one or more locking nub 129. In this configuration, bulb body 120 can be coupled with bulb mounting collar 110 such that each of the one or more locking nub 129 engages with one of the plurality of alignment notches 119 to align bulb body 120 to a corresponding one of a plurality of discrete angular engagement positions relative to bulb mounting collar 110.

First, in some embodiments, initial engagement of bulb mounting collar 110 with bulb body 120 can include passing bulb mounting collar 110 over shaft portion 124 of bulb body 120 until exterior mounting surface 127 is substantially nested within inner mounting surface 111 at a preliminary engagement position. In some embodiments, bulb mounting collar 110 includes one or more engagement rail 117 that is provided as a recessed track that extends along inner mounting surface 111 and that is configured to receive and guide the one or more locking nub 129 to the preliminary engagement position. In such a configuration, the preliminary engagement position can include the one or more locking nub 129 being positioned at or near an end of the one or more engagement rail 117, and coupling gasket 128 being positioned in contact with both of bulb mounting collar 110 and bulb body 120.

Figure 4A:
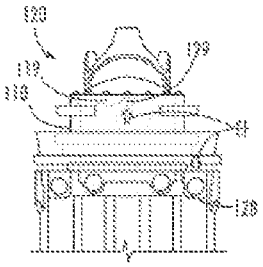
FIGS. 4A through 4E are side views of an engagement mechanism for elements of a headlight bulb assembly according to an embodiment of the presently disclosed subject matter.

Once bulb mounting collar 110 is in the preliminary engagement position, bulb mounting collar 110 can be further depressed towards base portion 122 of bulb body 120 such that the one or more locking nub 129 passes beyond the one or more engagement rail 117 in the axial direction. In some embodiments, this further depression involves compressing coupling gasket 128. From this position, bulb body 120 is rotatable relative to bulb mounting collar 110 to a desired angular orientation. Referring to FIG. 4A, for example, at a given angular position, each of the one or more locking nub 129 seats within a respective one of the plurality of alignment notches 119. In some embodiments, coupling gasket 128 exerts a force between base portion 122 and bulb mounting collar 110 to press bulb mounting collar 110 against the one or more locking nub 129 and thus bias the elements towards an engaged position.

Figure 4B:
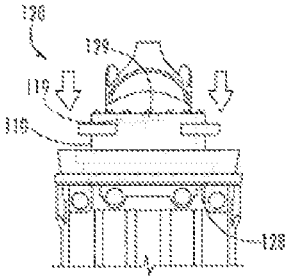
Figure 4C:
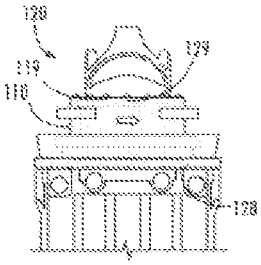
Figure 4D:
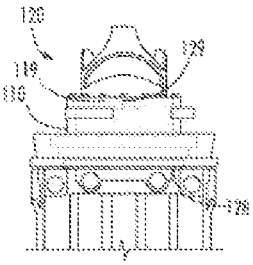
Figure 4E:
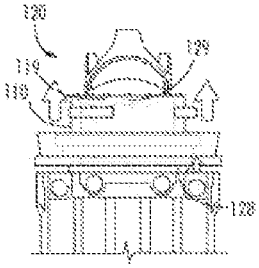

Further in this regard, changing angular orientations can involve depressing bulb mounting collar 110 towards base portion 122 as shown in FIG. 4B (e.g., while compressing coupling gasket 128) and rotating one of bulb mounting collar 110 or bulb body 120 relative to the another as shown in FIG. 4C. Once a new desired angular orientation is substantially reached, such as is shown in FIG. 4D, bulb mounting collar 110 can be moved back away from base portion 122 such that each of the one or more locking nub 129 seats within a new respective one of the plurality of alignment notches 119, such as is shown in FIG. 4E. Again, this reseating can be achieved through a restoring force of coupling gasket 128 tending to press bulb mounting collar 110 away from base portion 122 such that each of the one or more locking nub 129 is pressed into a new respective one of the plurality of alignment notches 119. In this way, bulb mounting collar 110 and bulb body 120 can be selectively engaged with one another in any of a plurality of relative angular positions.

In any configuration, by providing the headlight bulb as an assembly including multiple separate components, the position of the one or more LED element 125 can be adjusted independently from the connection of bulb mounting collar 110 to housing 150. Specifically, for example, in embodiments in which the opening in bulb mounting collar 110 is substantially circular, and exterior mounting surface 127 of bulb body 120 is substantially cylindrical, engagement between the elements can be achieved regardless of the angular position of bulb body 120 with respect to central axis C. Thus, in some embodiments, bulb body 120 can be rotatable to a range of angular positions relative to bulb mounting collar 110 and thus with respect to housing 150. In this regard, bulb body 120 need not be aligned at any particular angle with respect to bulb mounting collar 110 to be received by bulb mounting collar 110. Rather, bulb mounting collar 110 is configured to enable engagement with bulb body 120 in any of a range of relative angular orientations. In this way, the position of the one or more LED element 125 can be characterized as "clock-able" within housing 150 in that the relative orientation of the one or more LED element 125 with respect to housing 150 can be adjusted to optimize the illumination pattern within housing 150.

For example, in the configuration illustrated in FIG. 1, the one or more LED element 125 comprises two elements that are arranged on opposing sides of shaft portion 124 of bulb body 120. In this arrangement, depending on the configuration of the reflector positioned within the housing 150 and the angular orientation of the one or more LED element 125 with respect to such a reflector, there can be areas of poor illumination or no illumination in the lighting pattern produced by headlight bulb assembly 100. By enabling bulb body 120 to be rotatable independently from its connection to housing 150, however, the relative position of the one or more LED element 125 can be adjusted with respect to housing 150 to correspond with the particular reflector configuration of housing 150. In this way, the appearance of such darker spots can be reduced or eliminated by adjusting the orientation of the one or more LED element 125. For example, in some embodiments, there can be an optimum angular position of the one or more LED element 125 with respect to housing 150 at which the headlight bulb assembly 100 produces an illumination pattern having a maximum total brightness, a maximum light distribution across the reflector, or to otherwise produce a desired characteristic of the illumination pattern.

While providing this adjustability to the position of the one or more LED element 125, headlight bulb assembly 100 according to the presently disclosed subject matter can also provide the holding force that is desired in some headlight bulb configurations. As discussed above, some standards for halogen vehicle lamp bases are specified to require a minimum holding force (e.g., a minimum of 5N of force) once the bulb is inserted into the fixture to ensure that the bulb is correctly seated and/or to ensure alignment of the optics. To achieve this holding force, headlight bulb assembly 100 includes a biasing element 113 that is configured to apply a biasing force that acts to retain one or both of bulb mounting collar 110 or bulb body 120 in a desired position with respect to bulb base cavity 151, such as in a position that optimally orients the one or more LED element 125 with respect to the optics of housing 150. In some embodiments, for example, biasing element 113 is a tension spring.

Figure 5A:
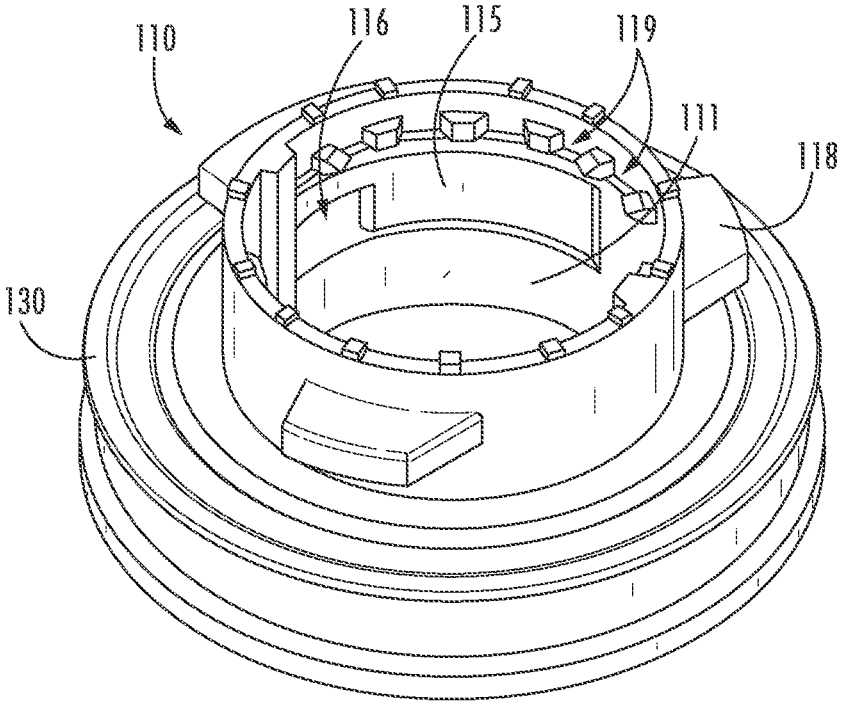
FIGS. 5A and 5B are side perspective views of a bulb mounting collar according to an embodiment of the presently disclosed subject matter.
Figure 5B:
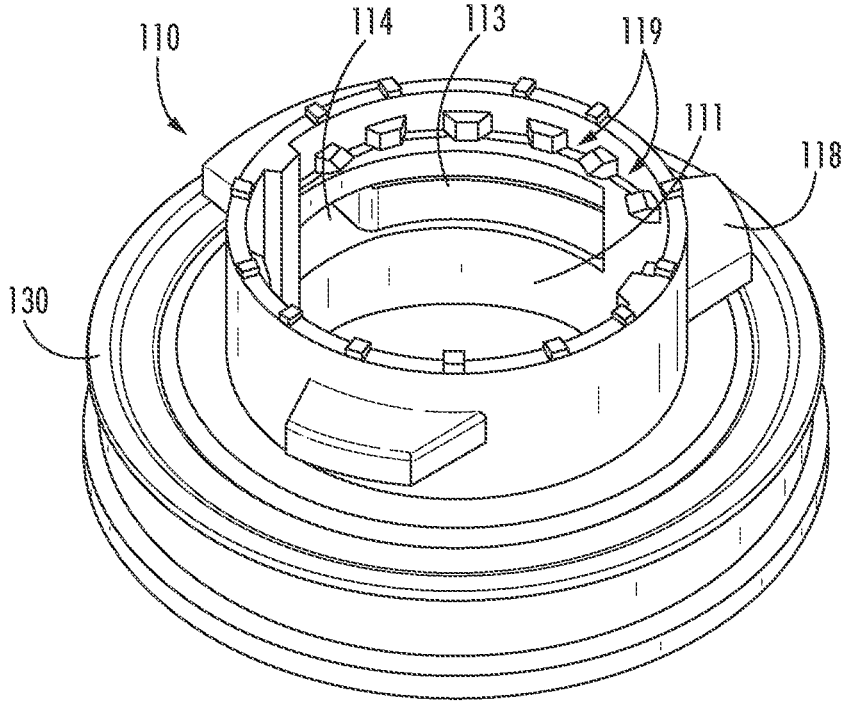

For example, in one exemplary embodiment illustrated in FIGS. 5A and 5B, bulb mounting collar 110 can include a cavity 115 on inner mounting surface 111, and an opening 116 from cavity 115 is formed through bulb mounting collar 110. Biasing element 113 can be provided as a tension spring that is sized and configured to be received in cavity 115, and biasing element 113 can include a projection 114 that is configured to protrude through opening 116. In this arrangement, when bulb mounting collar 110 and bulb body 120 are coupled together, biasing element 113 is secured in cavity 115 between inner mounting surface 111 of bulb mounting collar 110 and exterior mounting surface 127 of bulb body 120, and projection 114 protrudes outwardly through opening 116. In this arrangement, projection 114 of biasing element 113 can engage bulb base cavity 151 to help produce the holding force to keep headlight bulb assembly 100 seated within housing 150. Thus, bulb mounting collar 110 can be engaged with bulb base cavity 151 of housing 150 with a holding force that acts to retain headlight bulb assembly 100 in place with respect to housing 150. In addition, the biasing force applied by biasing element 113 can further help to secure bulb body 120 in place with respect to bulb mounting collar 110.

In one particular coupling configuration illustrated in FIGS. 6A through 6F, for example, housing 150 can be configured such that bulb base cavity 151 has a nonuniform opening that defines an arrangement of cutouts and indentations. Bulb mounting collar 110 can be sized and configured to pass through bulb base cavity 151 when aligned in a particular orientation. For example, the positions of projection 114 of biasing element 113 and/or the one or more mounting flange 118 can be designed to effectively align with cutouts in bulb base cavity 151. In the configuration illustrated in FIGS. 6A and 6B, opening 116 in bulb mounting collar 110 through which projection 114 of biasing element 113 protrudes is arranged in alignment with one or the one or more mounting flange 118, and these elements are sized to pass through a first cutout 152 that extends outwardly from bulb base cavity 151 in housing 150. Bulb mounting collar 110 is configured such that the one or more mounting flange 118 passes completely through bulb base cavity 151, but projection 114 of biasing element 113 remains effectively aligned within bulb base cavity 151.

Figure 6A:
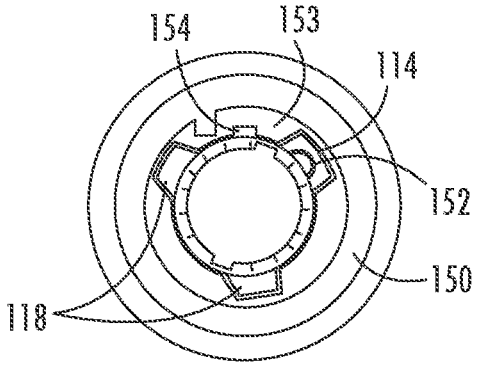
FIGS. 6A, 6C, and 6E are top views of method steps for coupling a bulb mounting collar to a headlight housing according to an embodiment of the presently disclosed subject matter.
Figure 6B:
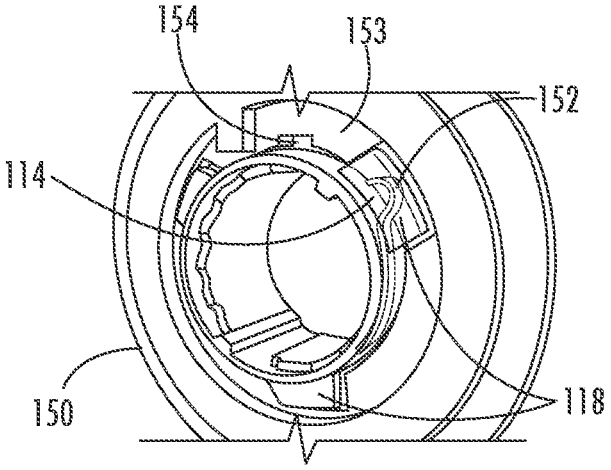
FIGS. 6B, 6D, and 6F are perspective side views of the method steps shown in FIGS. 4A, 4C, and 4E, respectively.
Figure 6C:
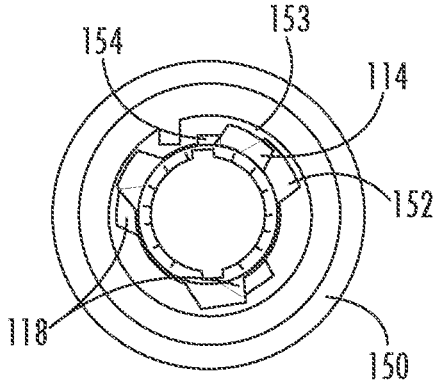
Figure 6D:
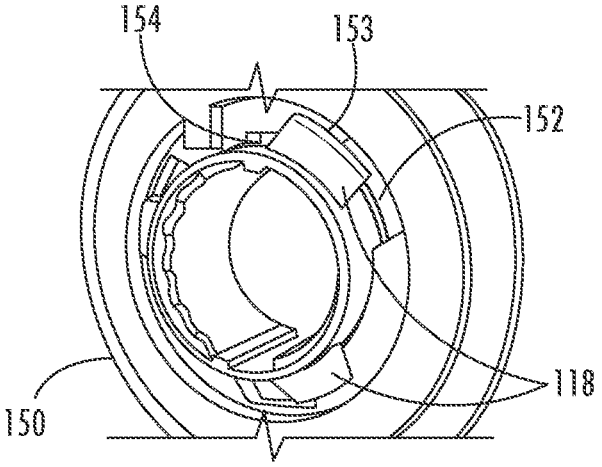
Figure 6E:
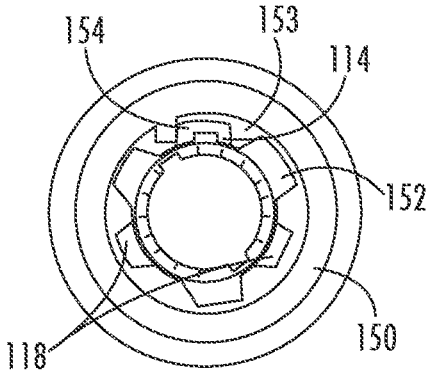
Figure 6F:
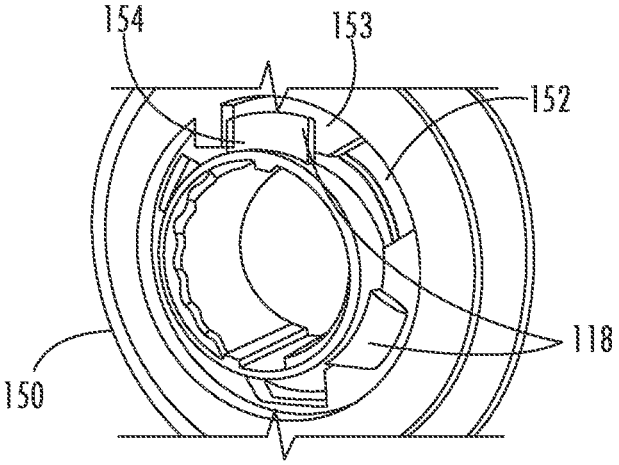

When arranged in this way, bulb mounting collar 110 can be rotated as shown in FIGS. 6C and 6D such that the one or more mounting flange 118 passes over an indentation 153 that extends back inward relative to first cutout 152, but projection 114 engages and is flexed inward by indentation 153. In some embodiments, the spring constant k of biasing element 113 can be selected such that an engagement pressure is applied between bulb base cavity 151 and headlight bulb assembly 100 with a desired minimum force, which in some embodiments is selected to be about 10N. As shown in FIGS. 6E and 6F, bulb mounting collar 110 can be further rotated until projection 114 passes beyond indentation 153 and flexes back up into a second cutout 154 that likewise extends outwardly from bulb base cavity 151. In some embodiments, second cutout 154 extends a shorter distance radially outward than first cutout 152. In this arrangement, projection 114 effectively "clicks" into place in second cutout 154, but the one of the one or more mounting flange 118 is larger and cannot pass back through bulb base cavity 151. When seated in this position, in some embodiments, edges of bulb base cavity 151 are bounded on one side by the one or more mounting flange 118 and on an opposing side by a lower portion of bulb mounting collar 110 and/or mounting gasket 130. In this way, an axial force persists in pressing bulb mounting collar 110 in a sealing arrangement against housing 150. In accordance with the preferred minimum holding force discussed above, bulb mounting collar 110 and/or mounting gasket 130 can be configured such that this axial force has a magnitude of at least 5N.

The present subject matter can be embodied in other forms without departure from the spirit and essential characteristics thereof. The embodiments described therefore are to be considered in all respects as illustrative and not restrictive. Although the present subject matter has been described in terms of certain preferred embodiments, other embodiments that are apparent to those of ordinary skill in the art are also within the scope of the present subject matter.

What is claimed is:

1. A headlight bulb assembly for a vehicle headlight comprising:

a bulb mounting collar configured to be engaged with a bulb base cavity in a housing of the vehicle headlight;

a bulb body comprising one or more LED element, wherein the bulb body is configured to be coupled to the bulb mounting collar, wherein the bulb body is rotatable to a range of angular positions relative to the bulb mounting collar such that the bulb body is arranged at any of a corresponding plurality of desired angular positions with respect to the bulb base cavity; and a biasing element configured to apply a force that acts to retain one or both of the bulb mounting collar or the bulb body in place with respect to the bulb base cavity.

2. The headlight bulb assembly of claim 1, wherein the bulb mounting collar is ring-shaped and comprises a substantially circular opening that defines a substantially cylindrical inner mounting surface; and wherein the bulb body comprises an exterior mounting surface that has a substantially cylindrical shape;

wherein the exterior mounting surface of the bulb body is sized and configured to nest within the inner mounting surface of the bulb mounting collar.

3. The headlight bulb assembly of claim 2, wherein the exterior mounting surface is sized and configured to engage the inner mounting surface in a press-fit arrangement.

4. The headlight bulb assembly of claim 2, wherein one or both of the bulb body or the bulb mounting collar comprises an engagement element configured to selectively retain the bulb mounting collar in a desired relative angular orientation with respect to the bulb body and in a desired axial position with respect to the bulb body.

5. The headlight bulb assembly of claim 4, wherein the engagement element comprises:

one or more locking nub that protrudes radially outward from the exterior mounting surface of the bulb body; and a plurality of alignment notches indented radially inward into the inner mounting surface of the bulb mounting collar;

wherein each of the plurality of alignment notches is configured to receive one of the one or more locking nub to align the bulb body to a corresponding one of a plurality of discrete angular engagement positions relative to the bulb mounting collar.

6. The headlight bulb assembly of claim 2, wherein the biasing element comprises a tension spring that is received in a cavity formed on the inner mounting surface of the bulb mounting collar and protrudes through an opening in the bulb mounting collar for engagement with the bulb base cavity.

7. The headlight bulb assembly of claim 1, comprising a coupling gasket configured to be coupled between the bulb mounting collar and the bulb body to seal a connection between the bulb mounting collar and the bulb body.

8. A vehicle headlight comprising:

a housing comprising a bulb base cavity;

a bulb mounting collar configured to be engaged with the bulb base cavity;

a bulb body comprising one or more LED element, wherein the bulb body is configured to be coupled to the bulb mounting collar, wherein the bulb body is rotatable to a range of angular positions relative to the bulb mounting collar such that the bulb body is arranged at any of a corresponding plurality of desired angular positions with respect to the bulb base cavity; and a biasing element configured to apply a force that acts to retain one or both of the bulb mounting collar or the bulb body in place with respect to the bulb base cavity.

9. The vehicle headlight of claim 8, wherein the housing comprises one or more reflector elements; and wherein the bulb body is rotatable to a range of angular positions relative to the bulb mounting collar to adjust an illumination pattern produced by a combination of the one or more LED element and the one or more reflector elements.

10. The vehicle headlight of claim 8, comprising a mounting gasket configured to be positioned between the bulb mounting collar and the bulb base cavity to seal a mating surface between the bulb mounting collar and the bulb base cavity.

11. A method for coupling a headlight bulb to a vehicle headlight, the method comprising:

coupling a bulb body to a bulb mounting collar, the bulb body comprising one or more LED element, wherein coupling the bulb body to the bulb mounting collar comprises rotating the bulb body to one of a range of angular positions relative to the bulb mounting collar;

engaging the bulb mounting collar with a bulb base cavity in a housing of the vehicle headlight, wherein the bulb body is arranged at any of a plurality of desired angular positions relative to the bulb base cavity corresponding to the range of angular positions of the bulb body relative to the bulb mounting collar; and applying a biasing force to hold the bulb body in place relative to the bulb base cavity.

12. The method of claim 11, wherein the desired position comprises a position at which the one or more LED element produces a desired illumination pattern.

13. The method of claim 11, wherein the bulb mounting collar is ring-shaped and comprises a substantially circular opening that defines a substantially cylindrical inner mounting surface;

wherein the bulb body comprises an exterior mounting surface that has a substantially cylindrical shape; and wherein coupling the bulb body to the bulb mounting collar comprises nesting the exterior mounting surface of the bulb body within the inner mounting surface of the bulb mounting collar.

14. The method of claim 13, wherein coupling the bulb body to the bulb mounting collar comprises engaging the exterior mounting surface with the inner mounting surface in a press-fit arrangement.

15. The method of claim 13, wherein coupling the bulb body to the bulb mounting collar comprises selectively retaining the bulb mounting collar in a desired relative angular orientation with respect to the bulb body and in a desired axial position with respect to the bulb body.

16. The method of claim 15, wherein the exterior mounting surface of the bulb body comprises one or more locking nub that protrudes radially outward from the exterior mounting surface;

wherein the bulb mounting collar includes a plurality of alignment notches indented radially inward into the inner mounting surface; and wherein coupling the bulb body to the bulb mounting collar comprises seating each of the one or more locking nub in one of the plurality of alignment notches to align the bulb body to a corresponding one of a plurality of discrete angular engagement positions relative to the bulb mounting collar.

17. The method of claim 11, wherein applying a biasing force comprises positioning a tension spring between the bulb body and the bulb base cavity.

18. The method of claim 17, wherein the tension spring is received in a cavity formed on an inner side of a wall of the bulb mounting collar and protrudes through an opening in the wall of the bulb mounting collar;

wherein applying a biasing force comprises engaging the tension spring with the bulb base cavity.

* * * * *